US010453374B2

(12) United States Patent
Ma

(10) Patent No.: US 10,453,374 B2
(45) Date of Patent: Oct. 22, 2019

(54) DISPLAY APPARATUS AND METHOD FOR DISPLAYING

(71) Applicant: SAMSUNG ELECTRONICS CO., LTD., Suwon-si (KR)

(72) Inventor: Gue-hwan Ma, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 106 days.

(21) Appl. No.: 15/861,160

(22) Filed: Jan. 3, 2018

(65) Prior Publication Data

US 2018/0374408 A1 Dec. 27, 2018

Related U.S. Application Data

(60) Provisional application No. 62/523,855, filed on Jun. 23, 2017.

(30) Foreign Application Priority Data

Sep. 4, 2017 (KR) ..... 10-2017-0112618

(51) Int. Cl.
*G09G 3/20* (2006.01)

(52) U.S. Cl.
CPC ... *G09G 3/2003* (2013.01); *G09G 2320/0233* (2013.01); *G09G 2320/0626* (2013.01); *G09G 2320/0666* (2013.01); *G09G 2360/141* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 6,611,297 | B1 * | 8/2003 | Akashi | H04N 21/4131 348/602 |
| 7,404,645 | B2 | 7/2008 | Margulis | |
| 9,058,765 | B1 * | 6/2015 | Mallick | G06F 3/0482 |
| 2004/0095402 | A1 * | 5/2004 | Nakano | G06F 3/0412 346/102 |
| 2009/0237423 | A1 * | 9/2009 | Shih | G09G 3/3406 345/690 |
| 2010/0079426 | A1 * | 4/2010 | Pance | G06T 11/001 345/207 |

(Continued)

FOREIGN PATENT DOCUMENTS

| | | | |
|---|---|---|---|
| KR | 10-2008-0075843 | A | 8/2008 |
| KR | 10-1014252 | B1 | 2/2011 |
| KR | 10-2015-0020210 | A | 2/2015 |

*Primary Examiner* — Duane N Taylor, Jr.
(74) *Attorney, Agent, or Firm* — Sughrue Mion, PLLC

(57) ABSTRACT

There is provided a display apparatus, which includes a display configured to display an image; a first sensor configured to detect a first light amount of first light which is incident in a first direction from a front side of the display apparatus; a second sensor configured to detect a plurality of second light amounts of different wavelength bands of second light which is incident in a second direction different from the first direction; and a processor configured to determine a position of a light source using any one of the plurality of second light amounts and the first light amount, correct the first light amount based on the position of the light source, and control an operation of the display apparatus based on the corrected first light amount.

20 Claims, 7 Drawing Sheets

(56) References Cited

U.S. PATENT DOCUMENTS

| | | | | |
|---|---|---|---|---|
| 2010/0148674 | A1 | 6/2010 | Braun et al. | |
| 2014/0009508 | A1 | 1/2014 | Woodgate et al. | |
| 2014/0285531 | A1 | 9/2014 | Dasher | |
| 2015/0348468 | A1* | 12/2015 | Chen | G09G 3/3413 345/207 |
| 2016/0063951 | A1* | 3/2016 | Ikizyan | G09G 5/02 345/590 |
| 2016/0140889 | A1* | 5/2016 | Wu | G09G 3/2003 345/207 |

* cited by examiner

DISPLAY APPARATUS AND METHOD FOR DISPLAYING

CROSS-REFERENCE TO RELATED APPLICATIONS

This application claims priority from Korean Patent Application No. 10-2017-0112618. filed on Sep. 4, 2017 in the Korean Intellectual Property Office and U.S. Provisional Patent Application No. 62/523,855, filed on Jun. 23, 2017, the disclosures of which are incorporated herein by reference in their entireties.

BACKGROUND

1. Field

Apparatuses and methods consistent with exemplary embodiments of the present disclosure relate to a display apparatus and a method for displaying and, more particularly, to a display apparatus which corrects light loss of a sensor according to a disposition environment of a display apparatus and accurately measures brightness of ambient environment so that the display apparatus can operate accurately, and a method thereof.

2. Description of the Related Art

A display apparatus is an apparatus to display an image signal received from an external image source. Recent display apparatuses are able to measure ambient brightness and display a screen according to the measured brightness in order to save power consumption or provide a clearer screen.

The measurement of the ambient light uses an optical sensor such as an illuminance sensor and a color sensor, and some recent display apparatuses include an optical sensor on a lower end of the display for improved design aesthetics.

If an optical sensor is disposed on a lower end of a display apparatus, however,the optical sensor is easily affected not only by the light directly illuminated by an external light source but also light reflected from a bottom surface.

In addition, according to types and disposition forms of light sources disposed in a space where a display apparatus is disposed, even if a display apparatus displays an image with the same brightness, a user may perceive brightness differently.

However, the conventional display apparatus performs brightness control without taking into account some of these subtle nuances in different light sources and a space in which the display apparatus is disposed.

SUMMARY

Exemplary embodiments address at least the above problems and/or disadvantages and other disadvantages not described above. Also, the exemplary embodiments are not required to overcome the disadvantages described above,and may not overcome any of the problems described above.

The present disclosure includes one or more exemplary embodiments that may address and/or solve the above-mentioned needs, and it is an object of the one or in exemplary embodiments of the present disclosure to provide a display apparatus which corrects light loss of a sensor according to a disposition environment of a display apparatus and accurately measuring brightness of ambient environment so that the display apparatus can operate accurately, a method thereof.

According to an aspect of an exemplary embodiment, there is provided a display apparatus which includes a display configured to display an image; a first sensor configured to detect a first light amount of first light which is incident in a first direction from a front side of the display apparatus; a second sensor configured to detect a plurality of second light amounts of different wavelength bands of second light which is incident in a second direction different from the first direction; and a processor configured to determine a position f a light source using any one of the plurality of second light amounts and the first light source, correct the first light amount based on the position of the light source, and control an operation of the display apparatus based on the corrected first light amount.

The processor may determine a type of the light source based on the plurality of second light amounts and correct the first light amount based on the position and the type of the light source.

The processor may adjust a color temperature of the image based on the type of the light source.

The processor may determine the position of the light source as one of a ceiling arrangement and a front arrangement based on a ratio of one of the plurality of second light amounts to the first light source.

The processor may control the display to display a message inducing a darkroom environment, control the display, in response to the darkroom environment being detected, to display the image with a predetermined brightness, and perform an initial correction with respect to the first sensor and the second sensor based on detected values of the first sensor and the second sensor in the darkroom environment and while the display apparatus is operating with the predetermined brightness.

The, processor may correct the, first light amount based on an installation environment of the display apparatus and the position of the light source.

The processor may determine a reflection ratio third direction toward a floor on which the display apparatus is disposed, by using the plurality of second light amount, and correct the first light amount in further consideration of the reflection ratio.

The processor may adjust brightness of the display based on the corrected first light amount.

The first sensor may be at least one of an illuminance sensor and a color sensor. The second sensor may be at least one of a color sensor, a charge-coupled device (CCD) sensor, and a complementary metal-oxide-semiconductor (CMOS) sensor.

The first sensor may be disposed on a backside of the display and the display apparatus may further include a reflection member which reflects light incident from a front surface of the display apparatus and directs the light toward the first sensor.

The second sensor may be disposed adjacent to the first sensor on the backside of the display and detect third light which is incident from a third direction of a floor on which the display apparatus is disposed.

According to an aspect of an exemplary embodiment, a method for displaying is disclosed. The method may include detecting a first light amount of first light which is incident in a first direction from a front side of the display apparatus; detecting a plurality of second light amounts of different wavelength bands of second light which is incident in a second direction different from the first direction; determining a position of a light source using any one of the plurality of second light amounts and the first light source; correcting the first light amount based on the position of the light source; and displaying an image based on the corrected first light amount.

The method may further include determining a type of the light source based on the plurality of second light amounts. The correcting may include correcting the first light amount based on the position and the type of the light source.

The displaying may include adjusting a color temperature of the image being displayed, based on the type of the light source.

The determining may include determining the position of the light source as one of a ceiling arrangement and a front arrangement based on a ratio of one of the plurality of second light amounts to the first light source.

The method for displaying may further include displaying a message inducing a darkroom environment, in response to the darkroom environment being detected, displaying the image with a predetermined brightness, and performing an initial correction with respect to the first sensor and the second sensor based on detected values the first sensor and the second sensor in the darkroom environment and while the display apparatus is operating with the predetermined brightness.

The correcting may include correcting the first light amount based on an installation environment of the display apparatus and the position of the light source.

The method may further include determining a reflection ratio in a third direction toward a floor on which the display apparatus is disclosed, by using the plurality of second light amounts. The correcting may include correcting the first light amount in further consideration of the reflection ratio.

The displaying the image may include adjusting brightness of the display based on the corrected first light amount.

A computer-readable recordable medium may store instructions which, when executed by a processor, cause the processor to perform operations including detecting a first light amount of first light which is incident in a first direction from a front side of the display apparatus; detecting a plurality of second light amounts of different wavelength bands of second light which is incident in a second direction different from the first direction; determining a position of a light source using any one of the plurality of second light amounts and the first light source; correcting the first light amount based on the position of the light source; and displaying an image based on the corrected first light amount.

BRIEF DESCRIPTION OF THE DRAWINGS

The above and/or other aspects will be more apparent by describing certain exemplary embodiments, with reference to the accompanying drawings, in which.

DETAILED DESCRIPTION

Figure 1:
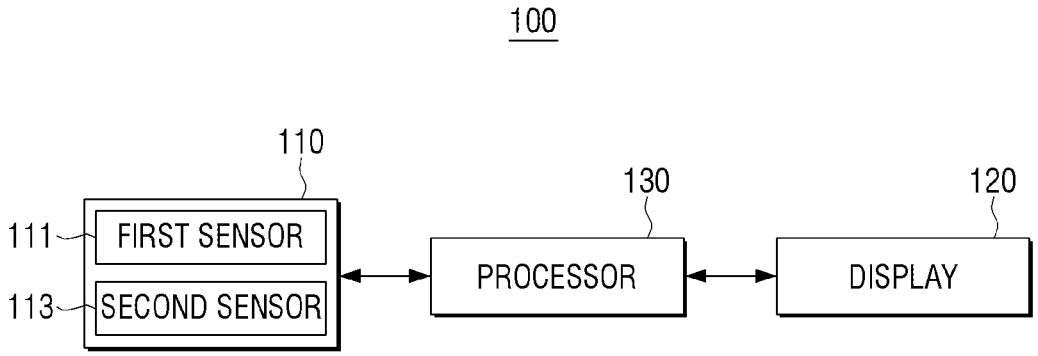
FIG. 1 is a block diagram which illustrates a schematic structure of a display apparatus according to an exemplary embodiment.

Reference will now be made in detail to exemplary embodiments with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, it is apparent that the exemplary embodiments may be practiced without those specifically defined matters. Also, well-known functions or constructions are not described in detail since they would obscure the description with unnecessary detail.

The terms such as "first," "second," and so on may be used to describe a variety of elements, but the elements should not be limited by these terms. The terms are used only for the purpose of distinguishing one element from another and they do not necessarily imply order or preference.

A singular expression includes a plural expression, unless otherwise specified. It is to be understood that the terms such as "comprise"or "consist of" are used herein to designate a presence of characteristic, number, step, operation, element, component, or a combination thereof, d not to preclude a presence or a possibility of adding one or more of other characteristics, numbers, steps, operations, elements, components or a combination thereof.

In the example embodiments of the present disclosure, a "module" or a "unit" may perform at least one function or operation,and be implemented as hardware (e.g., circuitry) or software, or as a combination of hardware and software. Further, except for the "module" or the "unit" that has to be implemented as particular hardware (e.g., a dedicated processor), a plurality of "modules" or a plurality of "units" may be integrated into at least one module and implemented s at least one processor. The word "exemplary" is used herein to mean "serving as an example or illustration." Any aspect or design described herein as "exemplary" is not necessarily o be construed as preferred or advantageous over other aspects or designs.

FIG. 1 is a block diagram which illustrates a schematic structure of a display apparatus according to an exemplary embodiment.

Referring to FIG. 1, a display apparatus 100 may include a sensor 110, a display 120, and a processor 130. The display apparatus 100 may be a TV or a monitor, etc.

The sensor 110 senses a lighting environment regarding surroundings of the display apparatus. To be specific, the sensor 110 is composed of an optical sensor and may sense illuminance (brightness) around the display and additionally sense directions and types of light source.

First, when the sensor 110 senses illuminance, the sensor 110 may sense the amount of light incident on the front surface of the display apparatus and sense the amount of light from directions other than the front direction (e.g., the direction orthogonal to the surface of the display screen). The sensor 110 may determine the direction of the light source using light amounts in different directions. Here, the direction of the light source may be the direction of the ceiling or the forward direction.

In addition, when the sensor 110 includes a color sensor capable of outputting a plurality of channels, the sensor 110 can determine the type of the light source based on the ratio of the plurality of channels. When the sensor 110 is disposed to sense the bottom direction of the display apparatus 100, the sensor 110 may determine the reflectance by detecting the bottom color (e.g., the color surface on which the display apparatus 100 is placed).

The operation of the sensor 110 may be realized by using one optical sensor or by using a plurality of optical sensors. Here, the optical sensor a sensor that can detect the brightness (illuminance) of light, and may be an illuminance sensor, a color, a charge-coupled device (CCD) sensor, a complementary metal-oxide-semiconductor (CMOS) sensor, or the like.

First, in the case of a single sensor, the sensor 110 may include a color sensor and a driving unit that can change the sensing direction of the color sensor. Specifically, the driving unit may drive the color sensor so that the color sensor faces the bottom surface when the bottom color is required to be sensed (for example, at the time of initial installation of the display apparatus or after removing and reattaching the power supply) and then faces the front direction again. The "bottom surface" may be a surface on which the display apparatus is disposed (e.g., a surface of a TV stand, a surface of a floor, etc.), and the "bottom color" may refer to a color of the bottom surface.

In the case of a plurality of sensors, the sensor 110 may include a plurality of sensors 111 and 113 arranged in different directions. In this case, the first sensor 111 may be an illuminance sensor or a color sensor for sensing the amount of light incident on the front surface of the display apparatus. The second sensor 113 may be a color sensor, a CCD sensor, a CMOS sensor, or the like for sensing the color of light incident from the bottom of the display apparatus.

Here, the illuminance sensor outputs one illuminance value or outputs illuminance values of the two channels. The color sensor is a sensor for outputting a sensing value (R/G/B) per predetermined color band, and may further output an infrared (IR) ray value corresponding to the average value W of the infrared ray.

In the above description, it is described that only two sensors 111 and 113 are used. However, three or more sensors may be used. In addition, if the type of the above-described sensor is merely an example, it is also possible to use a configuration other than the above-described sensor which may sense illuminance and color.

In the meantime, it has been described that the sensor 110 learns about a surrounding environment by itself, but in implementation, the sensor 110 may sense sensed color or light amount and provide to the processor 130, and processing information about a surrounding environment may be done by the processor 130.

Meanwhile, the sensors described above may be embedded in a frame of the display apparatus so as not to be affected by light emitted from the display 120. Specifically, the display apparatus 100 may be embedded in the lower portion of the front surface of the display apparatus 100 (e.g., bottom portion of a bezel), or may be disposed on the rear surface of the display apparatus 100. A specific example of the case where the display apparatus 100 is disposed on the rear surface will be described later with reference to FIG. 3.

The display 120 displays an image. The display 120 may be implemented as various types of displays such as a liquid crystal display (LCD), a plasma display panel (PDP), an organic light emitting diode (OLED), and a quantum dot light-emitting diode (QLED). In the case of the LCD, the display 120 may include a driving circuit and a backlight unit, which may be implemented in the form of an a-si TFT, a low temperature poly silicon (LTPS) TFT, an organic TFT (OTFT). Meanwhile, the display 120 may be implemented as a touch screen in combination with the touch sensor.

In case of the LCD, the display 120 includes backlight. Here, the backlight is a point source of light composed of a plurality of light sources and may support local dimming.

Here, the light source constituting the backlight may be composed of a cold cathode fluorescent lamp (CCFL) or a light emitting diode (LED). Hereinafter, the backlight is illustrated as being composed of a light emitting diode and a light emitting diode driving circuit, but may be implemented in configurations other than the LED at the time of implementation. The plurality of light sources constituting the backlight can be arranged in various forms, and various local dimming techniques can be applied. For example, the backlight may be a direct type backlight in which a plurality of light sources are arranged in a matrix form and are uniformly arranged over the entire liquid crystal screen. In this case, the backlight can operate with full-array local dimming or direct local dimming. Here, the full-array local dimming is a dimming method in which the light source is uniformly disposed behind the LCD screen and the brightness of each light source is adjusted. Direct local dimming is similar to the full-array local dimming method, but it is a dimming method that adjusts the luminance of each light source with a smaller number of light sources.

In addition, the backlight may be an edge type backlight in which a plurality of light sources are disposed only at the edge portion of the LCD. In this case, the backlight can operate with edge-lit local dimming. In the edge-lit local dimming, a plurality of light sources are disposed only on the edge of the panel, and may be disposed only on the left/right side, only on the upper/lower side, or on the left/right/upper/lower sides.

The display 120 performs dimming based on light amount sensed by the sensor 110 and display an image with brightness which is adaptive to surrounding brightness.

The processor 130 controls overall operations of the display apparatus 100. Specifically, the operation mode of the display apparatus 100 is determined. When the processor 130 receives the TV display command or the content display command from the user, the processor 130 can determine that the operation mode is the normal image display mode. Here, the operation mode is an operation state for displaying a general image.

When the display apparatus 100 is in an operation mode, if a user presses a power button, the processor 130 may be changed to a power-off mode.

When a power command is input in the power-off mode, the processor 130 may control each configuration of the display apparatus 100 so as to operate as a normal mode.

In a case where the initial power is applied to the display apparatus 100 or the language is not set, the processor 130 can determine the initial operation mode. If it is determined to be the initial mode of operation, the processor 130 may control the display 120 to display a message for initialization. Here, the message is a message that the environment in which the display apparatus 100 is disposed should be set as a darkroom environment. That is, when the display apparatus 100 is disposed in the living room, it may be a message to turn off the light of the living room.

The processor 130, in a darkroom environment, makes the display 120 display an image with predetermined brightness and correct an output value of the sensor 110 through the measured value.

In addition, the processor 130 may display a message (or a user interface) for setting the installation environment of the display apparatus from the user. Thus, it can be determined whether the display apparatus is installed in the form of a stand or a wall-hanging. In addition, when the display apparatus is installed in the form of a wall-hanging, the distance between the display apparatus and the floor surface can be input from the user. When the display apparatus is installed in the form of a stand, the color of the bottom surface of the display apparatus can be input from the user. The initial operation mode may be preformed in units of a predetermined time period (for example, a day, a week, etc.). In other words, the measurement and adjustment may be performed at predetermined time intervals.

Upon receiving the amount of light detected by the sensor 110, the processor 130 determines the position and type of the light source. Specifically, the processor 130 may determine the position of the light source by using one of the plurality of the detected second light amount, and the detected first light amount. This operation will be described in detail with reference to FIG. 6.

The processor 130 determines types of light source using the plurality of first light amount which is output from the color sensor of the sensor 110.

In addition, the processor 130 determines the color of the bottom direction using a plurality of first light amount output from the color sensor of the sensor 110. Based on this, the processor 130 can determine the loss rate (or reflectivity) of light incident from the front direction.

The processor 130 may perform the determining operation in a predetermined time unit or perform the operation in an initial setting process.

Then, the processor 130 performs a correction for the first light amount with respect to the light incident from the front direction based on the determined position of the light source. Specifically, the processor 130 may determine a correction factor by combining not only the direction of the light source but also the type of the light source, the installation environment, the loss ratio, etc., and perform correction for the first light amount based on the determined correction factor.

To this end, the display apparatus 100 stores a lookup table having a correction factor corresponding to each of the light source direction, the light source type, the installation environment, and the loss ratio, and the processor 130 extracts the correction factor using the stored lookup table, and perform correction for the first light amount with the extracted correction factor.

Here, the correction factor is a factor used in a formula for generating the value of the signal output from the sensor and the actual illuminance value. If the equation is a linear function, there may be one correction factor, and if it is a quadratic function, there may be two correction factors. Although two correction factors are used in this embodiment as shown in FIG. 9, one correction factor may be used in the implementation, and three or more correction factors may be used.

The processor 130 may then perform image processing on the image according to the sensed lighting environment (i.e., lighting direction and lighting brightness) In detail, the processor 130 may perform image processing for converting the color temperature of the image based on the color temperature sensed by the sensor 110.

The processor 130 may control the display 120 to display the image with the brightness corresponding to the corrected light amount. For example, the processor 130 may control the display 120 to display an image at a luminance (brightness) corresponding to the corrected light amount. Specifically, the brightness control may be performed by adjusting the brightness value of the image data itself, or may be performed by adjusting the brightness of the backlight. Further, the image processing and dimming control described above can also be performed in a combined manner.

In addition, when the, detected light amount which is sensed in real time or periodically and corrected is changed by more than a predetermined range, that is, when the surrounding environment changes (for example, the lighting is turned on or the lighting is turned off), the processor 130 may control the display 120 to display the image with the luminance corresponding to the changed light amount.

In contrast, when the change of the light amount which is sensed and corrected in real time or periodically is less than a predetermined range the processor 130 may determine that a surrounding environment is not changed and control the display 120 to display an image with luminance which corresponds to the currently set light amount.

As described above, the display apparatus 100 according to the present embodiment gathers various types of information about the environment in which the display apparatus 100 is located, and corrects the sensed amount of light accordingly, thereby more accurately measuring the brightness around the display apparatus. Further, by using the accurately measured light amount, the display apparatus 100 can adjust luminance more precisely corresponding to the detected light amount.

Figure 2:
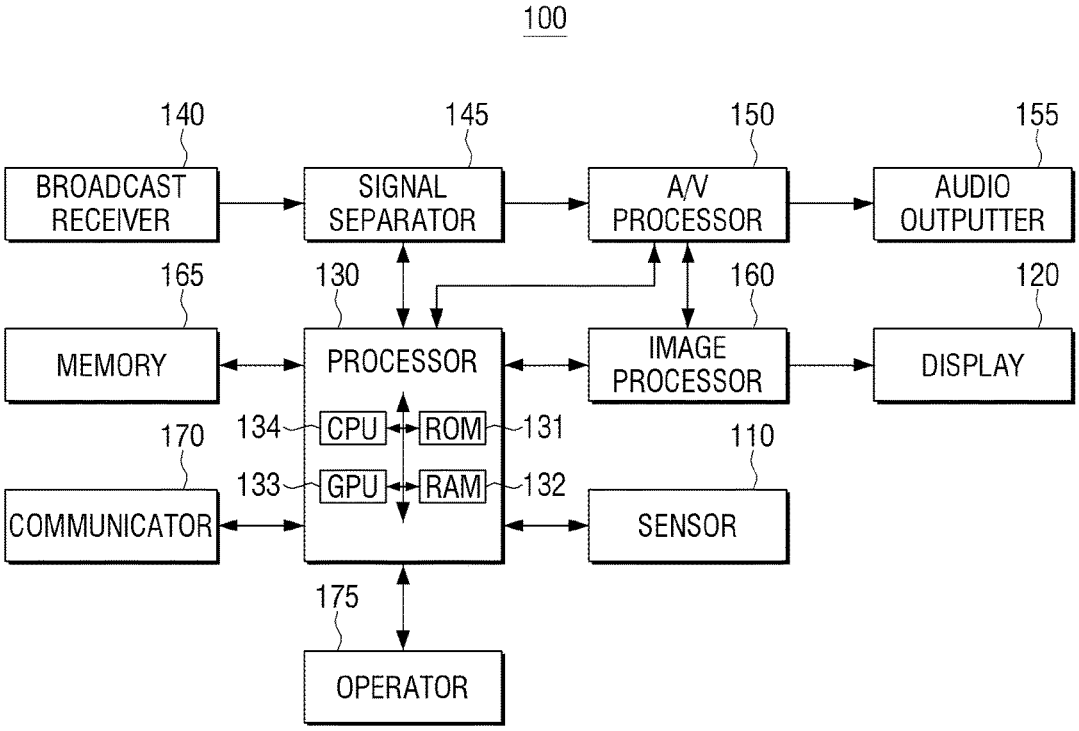
FIG. 2 is a block diagram which illustrates a detailed structure of a display apparatus according to an exemplary embodiment.

Hereinafter, a brief configuration of the display apparatus 100 has been described but the display apparatus 100 may additionally include the, configuration as illustrated in FIG. 2. The detailed configuration of the display apparatus 100 will be described below with reference to FIG. 2.

FIG. 2 is a block diagram which illustrates a detailed structure of a display apparatus according to an exemplary embodiment.

Referring to FIG. 2, the display apparatus 100 according to the present embodiment includes a sensor 110, a display 120, a processor 130, a broadcast receiver 140, a signal separator 145, an image processor 160, an audio outputter 155, a memory 165, a communicator 170, and an operator 175.

The features of the sensor 110 and the display 120 are the same as the features of FIG. 2 and are not further described.

The broadcast receiver 140 receives and demodulates broadcasts from a broadcast station or satellite by wire or wirelessly. Specifically, the broadcast receiver 140 receives and demodulates a transmission stream through an antenna or a cable, and outputs a digital transmission stream signal.

The signal separator 145 separates the transmission stream signal provided from the broadcast receiver 140 into a video signal, an audio signal, and an additional information signal. The signal separator 145 transmits the video signal and the audio signal to the audio/video (A/V) processor 150.

The broadcast receiver 140 and the signal separator 145 are the configurations when the display apparatus 100 is implemented as a TV, and in the case where the display apparatus 100 is configured as a monitor, the broadcast receiver 140 and the signal separator 145 may be omitted.

The A/V processor 150 performs signal processing such as video decoding, video scaling, and audio decoding on the video signals and audio signals input from the broadcast receiver 140 and the memory 165. Although the video decoding and the video scaling are performed in the A/V processor 150 in the present embodiment, the above-described operations can be performed in the image processor 160. The A/V processor 150 outputs the video signal to the video processor 160 and outputs audio signals to the audio outputter 155.

On the other hand, when the received video and audio signals are stored in the mentor) 165, the A/V processor 150 can output the video and audio to the memory 165 in a compressed form.

The audio outputter 155 converts an audio signal output from the A/V processor 150 into a sound and outputs the sound through a speaker or to an external device connected through an external output terminal.

The image processor 160 generates a graphical user interface (GUI) for providing to the user. The GUI may be an on-screen display (OSD), and the image processor 160 may be implemented by a digital signal processor (DSP).

The image processor 160 may add the generated GUI to the image output from the A/V processor 150 to be described later. The image processor 160 may provide the display 120 with a video signal corresponding to the image to which the GUI is added. Accordingly, the display 120 displays various information provided by the display apparatus 100 and an image transmitted from the image processor 160.

Then, the image processor 160 extracts brightness information corresponding to the image signal, and generates one dimming signal (when the display apparatus operates as global dimming) corresponding to the extracted brightness information or a plurality of dimming signals (when the display apparatus operates as local dimming). The image processor 160 may generate the dimming signal in consideration of the illumination environment sensed by the sensor 110. That is, the image processor 160 may generate a dimming signal having a screen brightness according to the detected ambient brightness. This dimming signal may be a pulse width modulation (PWM) signal.

The memory 165 may store an image content. To be specific, the memory 165 may receive and store an image content in which an image and an audio are compressed by the A/V processor 150 and output the stored image content to the A/V processor 150 according to a control of the processor 130.

The memory 165 stores a lookup table having a plurality of colors and correction coefficients corresponding to each of the, plurality of colors. In addition, the memory 165 may store a lookup table having correction coefficients corresponding to each of a plurality of colors and a plurality of distances. The memory 165 may be implemented as a nonvolatile memory (e.g., a hard disk, a solid-state drive (SSD), a flash memory), a volatile memory, or the like.

The operator 175 is implemented as a touch screen, a touch pad, a key button, a keypad, or the like, and provides a user operation of the display apparatus 100. In other words, the operator 175 may he a user interface. In the present embodiment, it is described that a control command is received through the operator 175 provided in the display apparatus 100, but the operator 175 may receive a user operation from an external control device (for example, a remote control).

The operator 175 may receive environment setting of an installation environment of the display apparatus (for example, whether it is installed in a stand type or a wall-hanging type). If it is installed as a wall-hanging type, the operator 175 can receive a distance between the bottom surface (e.g., a surface of a floor) and the display apparatus. Further, the operator 175 may receive the color of the floor surface directly from the user.

The communicator 170 is configured to perform communication with various types of external devices according to various types of communication methods. The communicator 170 may include a Wi-Fi chip and/or a Bluetooth chip. The processor 130 can perform communication with various external devices using the communicator 170. Specifically, the communicator 170 can receive a control command from a control terminal device (for example, a remote control) capable of controlling the display apparatus 100.

Though not illustrated in FIG. 2, the communicator 170 may include a Universal Serial Bus (USB) port to which a USB connector can be connected, various external input ports for connecting to various external terminals such as a headset, a mouse, a local area network (LAN), and the like, a digital multimedia broadcasting (DMB) chip for receiving and processing a DMB signal, and the like.

The processor 130 controls overall operations of the display apparatus 100. To be specific, the processor 130 may control the image processor 160 and the display 120 to display an image according to a control command which is input through the operator 175.

The processor 130 may include a read-only memory (ROM) 131, random access memory (RAM) 132, graphics processing unit (GPU) 133, central processing unit (CPU) 134, and bus. The ROM 131, RAM 132, GPU 133, CPU 134 may be interconnected through the bus.

The CPU 134 accesses the memory 165 and performs booting using an operating system (OS) stored in the memory 165. The CPU 134 may perform various operations using various programs, contents, data stored in the memory 165, and the like. The operation of the CPU 134 is the same as the operation of the processor 130 of FIG. 1, and redundant explanations are omitted.

The ROM 131 stores a command set for booting the system. The CPU 134 copies the OS stored in the memory 165 to the RAM 132 according to the command stored in the ROM 131, executes the OS, and boots the system. When the booting is completed, the CPU 134 copies various programs stored in the memory 165 to the RAM 132, executes the program copied to the RAM 132, and performs various operations.

The GPU 133, when booting of the display apparatus 100 is completed, may generate a screen including various objects such as an icon, an image, and a text. The configuration of GPU may be configured as a separate configuration such as the image processor 160 or implemented as a configuration as system-on-chip (SoC) connected with the CPU within the processor 130.

According to the display apparatus 100 of the present embodiment as described above, the display apparatus 100 detects various information about the environment where the display apparatus 100 is located, and corrects sensed light amount d thus, it is possible to measure brightness around the display apparatus more accurately. Further, by using the accurately measured light amount, the display apparatus 100 can adjust luminance more precisely corresponding to the detected light amount.

Figure 3:
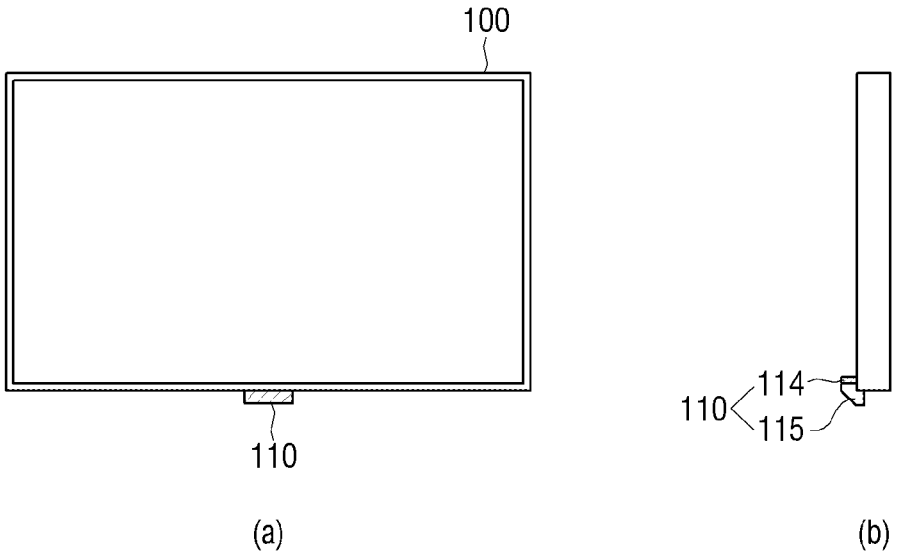
FIG. 3 illustrates a detailed disposition of a sensor according to an exemplary embodiment.

FIG. 3 illustrates a detailed disposition of a sensor according to an exemplary embodiment.

Referring to FIG. 3, the sensor 110, when the sensor is seen from a front side of the display apparatus 100, is disposed on a bottom (e.g., below the TV screen). To be specific, the sensor is disposed to be exposed in part in a direction of a bottom of the display apparatus 100. Here, the front side is a side that the display apparatus 100 displays an image (e.g., the side that faces a viewer) and a rear side is a side opposite to the side where the image is displayed.

The sensor 110 can be composed of a substrate area 114 in which a plurality of sensors are disposed and a reflection member 115, In the substrate area 114, a plurality of sensors 111, 113 are disposed. A disposition shape of the plurality of sensors 111, 113 will be described later with reference to FIGS. 4 and 5.

The reflection member 115 reflects light incident from a front side of the display towards the first sensor. The reflection member 115 may be composed of a waveguide or a reflection plate and a guide member.

Here, the waveguide is a transmission path for transmitting electrical energy or signals along an axis. In the present disclosure, a light pipe or an optical waveguide may be used. The optical waveguide is a circuit or line that transmits an optical signal, which may be an optical fiber or a thin film waveguide.

If the reflection member 115 is embodied as an optical waveguide, the cross section of the conduit of the waveguide may be located in the image sensor and the other cross section of the conduit may be disposed in the front direction of the display apparatus. Since the cross section of the optical waveguide is smaller than the cross section of the lens of the image sensor, the size of the exposed surface of the display apparatus 100 is smaller than that of the conventional image sensor.

In FIG. 3(*a*), it is described that the sensor 110 is illustrated as having a relatively large size in the display apparatus 100, but this is to make explanation easy, and the width and size of the sensor in a 30 inch or larger display apparatus may have a much smaller portion than the illustrated ones and thus, a user may not easily recognize the sensor.

In FIG. 3(*b*), it is illustrated that the rear surface of the display apparatus 100 slightly protrudes, but this is for making description easy. It may be less protruding than an area that engages with the bracket for fixing the display apparatus 100 to the wall or the standing member for standing.

In FIG. 3, it is described that the sensor is disposed at a lower end of the display apparatus, but in implementation, the sensor 110 may be disposed on an upper end or left/right side of the display apparatus.

Figure 4:
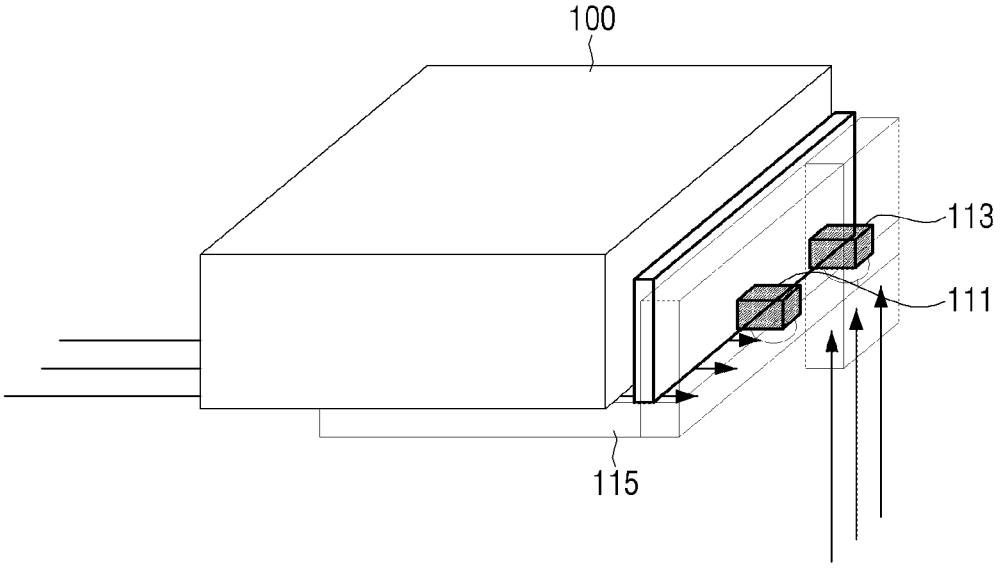
FIGS. 4 and 5 illustrate a disposition structure when a sensor 110 is configured using two sensors.
Figure 5:
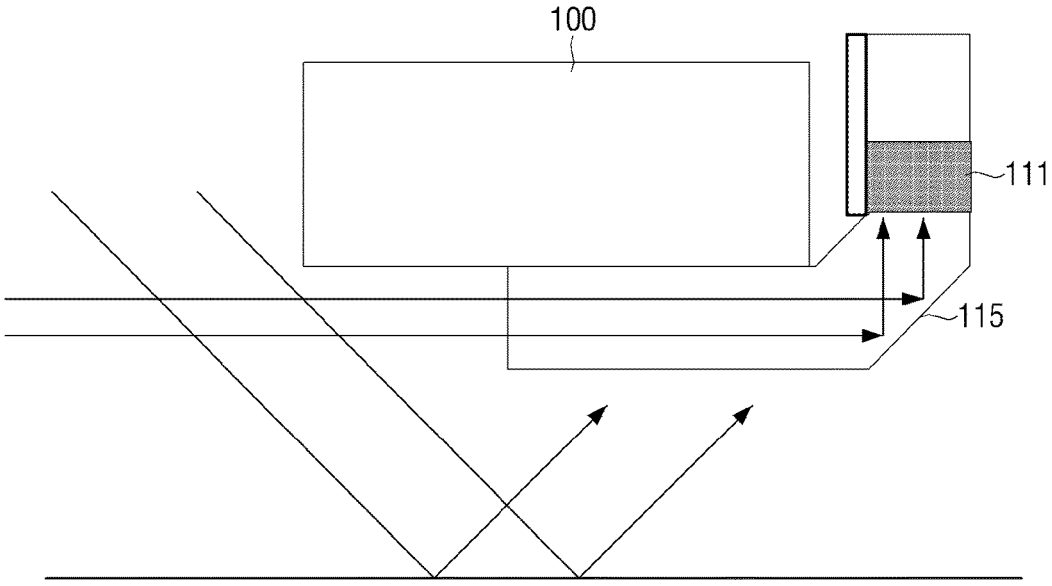

FIGS. 4 and 5 describe a disposition structure that the sensor 110 is composed of two sensors.

Referring to FIGS. 4 and 5, the sensor 110 may include a first sensor 111, a second sensor 113, and the reflection member 115.

The first sensor 111 is disposed on a rear side of the display apparatus 100, and is disposed in a direction toward a bottom side of the display apparatus 100. The first sensor 111 may be an illuminance sensor or a color sensor.

The second sensor 113 is disposed to be adjacent to the first sensor 111 on a rear side of the display apparatus 100 and is disposed in a direction facing a bottom of the display apparatus 100. The second sensor 113 may be a color sensor, a CCD sensor, and a CMOS sensor.

The reflection member 115 reflects light incident from a front side of the display apparatus and forms an image on the first sensor 111. Thee reflection member 115 may be composed of a waveguide, a reflection plate, and/or a guide member.

In describing FIGS. 4 and 5, it is described that two sensors are disposed on the rear surface of the display apparatus 100. However, in implementation, both sensors may be disposed on the lower portion of the front surface of the display apparatus 100. Also, in implementation,the first sensor may be disposed on the front surface of the display apparatus 100, and the second sensor may be disposed on the rear surface of the display apparatus 100. With respect to FIG. 1, the sensor 110 may be implemented using one optical sensor and a driving unit that can change the direction of the optical sensor.

Figure 6:
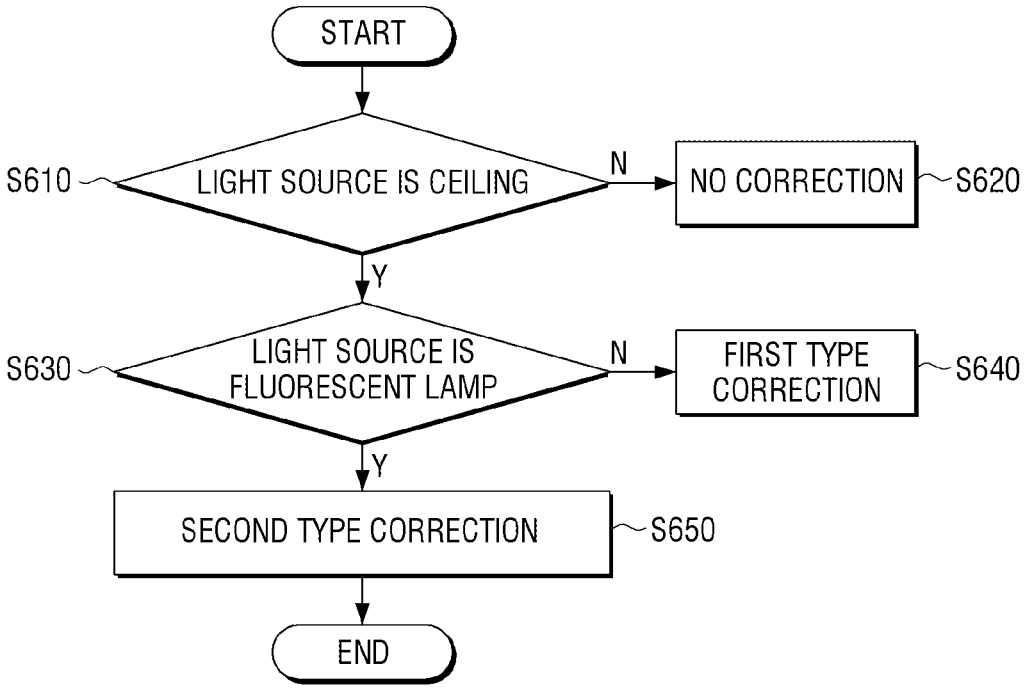
FIG. 6 illustrates a detailed method for determining a correction factor based on types and positions of a light source.

FIG. 6 is a view to describe a detailed method for determining a correction factor based on types and position of a light source.

Hereinbelow, for easy description, it is assumed that the first sensor is an illuminance sensor which outputs amount of light which is incident from the front surface as four sensing values (red (R), green (G), blue (B), and white(W)).

Referring to FIG. 6, the direction of a light source is determined based on a ratio of an output value of the first sensor to an output value of the second sensor (S610). Specifically, it is possible to compare whether the ratio of the value of the W channel of the first sensor to the value of the first channel (Ch0) of the second sensor is greater than a predetermined value as shown in the following Equation 1.

$$\frac{W}{Ch0} > 11 \qquad \text{[Equation 1]}$$

Here, W is a W channel value of the color sensor and Ch0 is the first channel value of the illuminance sensor.

As a result of the determination, if W/Ch0 is less than the example preset value 11 (S610—N), it can be determined that the light source is disposed on the front side. When the light source is disposed on the front surface, light loss does not occur to the illuminance sensor due to environment and thus, the processor 130 may use the light amount sensed from the illuminance sensor as it is without performing additional correction (S620).

In contrast, when W/Ch0 is greater than or equal to the preset value (e.g., 11), it can be determined that the light source is disposed on a ceiling (S610—Y). If the light source is disposed on a ceiling, light loss can occur in the illuminance sensor and the processor 130 performs additional operation as shown below.

Next, the type of the light source is determined using the ratio of the plurality of outputs of the second sensor (S630). Specifically, it is possible to compare whether the ratio of the sum value of the R/G/B channels of the second channel to the triple multiple value of the W channel is greater than a predetermined value as shown in Equation (2) below.

$$\frac{(R+G+B)}{3\times W} \geq J_{Max1} \qquad \text{[Equation 2]}$$

Here, R indicates R channel value of a color sensor, G is a G channel value of the color sensor, B is a B channel vale of the color sensor, and $J_{max1}$ is a preset constant number (for example, 80).

As a result of the determination, if the ratio is equal to or less than the predetermined value $J_{max1}$ (S630—N), it can be determined that the type of the light source is the LED. In this case, the processor 130 may perform the correction as shown in Equation 3 below for the amount of light detected by the illuminance sensor, but may not perform the color temperature correction for the image.

$$Lux = Lux_C * \left(1 + \ln\left(\frac{3G}{Ch1}\right) \Big/ 2\right) \quad \text{[Equation 3]}$$

Here, Lux indicates corrected light amount, $Lux_c$ is light amount sensed by the illuminance sensor, G is a value of the G channel of a color sensor, and Ch1 is a value of the second channel of the illuminance sensor.

Meanwhile, during implementation, so that compensation of light amount is not equal to or greater than a predetermined level, if a value of 3G/Ch1 is less than 0.5, 0.5 can be used and if 3G/Ch1 is greater than 1.5, 1.5 can be used.

Conversely, if the ratio is greater than the preset value (e.g., 11), it can be determined that the light source is a fluorescent lamp (S630—Y). In this case, the processor 130 may perform, color temperature correction on the image while performing correction for the light amount detected by the luminance sensor, as shown in Equation (4) below.

$$Lux = Lux_C * \left(1 + \frac{150 - Lux_C}{3Lux_C + 1}\right) \quad \text{[Equation 4]}$$

Here, Lux indicates compensated light amount and Lux, indicates light amount sensed by the illuminance sensor.

When the display apparatus 100 is installed as a wall-hanging type, the aforementioned operation to determine a direction and a type of a light source may be performed, but compensation (i.e., correction) of light amount sensed by the illuminance sensor may not be performed.

In addition, when the color of a surface where the display apparatus 100 is disposed is determined and loss ratio of light is measured, correction of high light amount sensed by the first sensor can be performed in consideration of the loss rate and the aforementioned equation.

Figure 7:
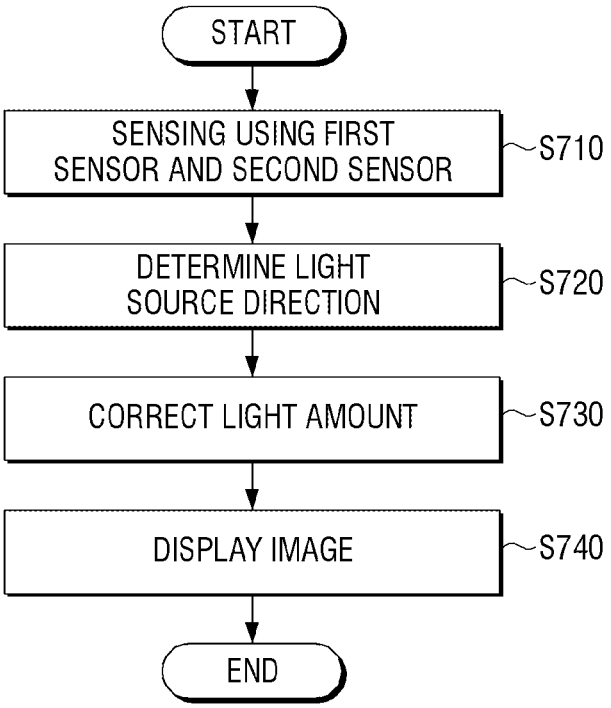
FIG. 7 is a flowchart to describe a method for displaying according to an exemplary embodiment.

FIG. 7 is a flowchart to describe a method for displaying according to an exemplary embodiment.

First, when the display apparatus is initially installed, a message for inducing a darkroom environment is displayed for initialization of the sensor. When the darkrooms environment is detected, an image is displayed with a predetermined brightness, and during the operation of the darkroom environment and predetermined brightness, an initial correction pray be performed for the first sensor and the second sensor based on the sensed values of the first sensor and the second sensor.

In addition, an installation environment of the display apparatus can be set from a user. To be specific, whether the display apparatus is installed as a stand type or a wall-hanging type and in case of the wall-hanging type, the distance to the bottom (e.g., floor) be manually entered by the user.

After the initial setup is completed, the light amount is detected using the first sensor and the second sensor (S710). Specifically, a first light amount of light incident on the front surface of the display apparatus is sensed using a first sensor, and a plurality of second light amounts of different wavelength bands are detected using a second sensor arranged in a different direction from the first sensor.

In operation 5720, the position of the light source is determined using any one of the plurality of detected second light amounts and the detected first light amount. Specifically, the position of the light source is determined based on the ratio of any one of the detected second light amounts (e.g., W channel) to the detected first light amount (for example, Ch0) in a ceiling arrangement or a front arrangement.

In addition, by using a plurality of second light amounts, a type of a light source can be determined. To be specific, whether a combination (for example, (R+G+B)/3W) of a plurality of second light amounts is equal to or greater than a preset ratio, it can be identified whether a light source is LED or fluorescent light.

Further, the reflection ratio in the bottom direction of the display apparatus can be determined using a plurality of second light amounts. Specifically, the color of the bottom of the display apparatus can be confirmed using a plurality of second light amounts, and the reflection ratio corresponding to the identified color can be determined.

Based on the determined position of a light source, first light amount is corrected (S730). To be specific, the first light amount can be corrected in consideration of an installation environment of the display apparatus, a location of light source, a type of light source, and a reflection ratio.

The image is displayed based on the corrected first light amount (S740). Specifically, an image can be displayed by adjusting the brightness of the display based on the corrected light amount. In addition, when the type of the light source around the display apparatus is determined, the color temperature of the image can be adjusted according to the type of the determined light source to display the image.

As described above, the display method according to the present embodiment enables receiving various information about the environment where the display apparatus 100 is located and correct the detected light amount and thus, it is possible to more accurately measure the brightness around the display apparatus. Further, by using the accurately measured light amount, the display apparatus 100 can adjust luminance more precisely corresponding to the detected light amount. The display method as shown in FIG. 7 can be executed on a display apparatus having the configuration of FIG. 1 or FIG. 2, or on a display apparatus having other configurations.

The display method according to the aforementioned exemplary embodiment may be implemented as a program (e,g., computer instructions) and provided to a display apparatus. A program including display method can be stored in a non-transitory recording medium and provided.

The non-transitory computer-recordable medium is not a medium configured to temporarily store data such as a register, a cache, or RAM but an apparatus-readable medium configured to permanently or semi-permanently store data. Specifically, the above-described various applications or programs may be stored in the non-transitory apparatus-readable medium such as a compact disc (CD), a digital versatile disc (DVD), a hard disk drive, a Blu-ray disc, a USB memory, a memory card, or a ROM, and provided therein.

The foregoing exemplary embodiments and advantages are merely exemplary and are not to be construed as limiting the inventive concept. The exemplary embodiments may be readily applied to other types of device or apparatus. Also, the description of the exemplary embodiments is intended to be illustrative, and not to limit the scope of the inventive concept, and many alternatives, modifications, and variations will be apparent to those skilled in the art.

What is claimed is:

1. A display apparatus comprising:

a display configured to display an image;

a first sensor configured to detect a first light amount of first light which is incident in a first direction from a front side of the display apparatus;

a second sensor configured to detect a plurality of second light amounts of different wavelength bands of second light which is incident in a second direction different from the first direction; and a processor configured to:

determine a position of a light source using any one of the plurality of second light amounts and the first light amount, correct the first light amount based on the position of the light source, and control an operation of the display apparatus based on the corrected first light amount.

2. The display apparatus as claimed in claim 1, wherein the processor is further configured to determine a type of the light source based on the plurality of second light amounts and correct the first light amount based on the position and the type of the light source.

3. The display apparatus as claimed in claim 2, wherein the processor is further configured to adjust a color temperature of the image based on the type of the light source.

4. The display apparatus as claimed in claim 1, wherein the processor is further configured to determine the position of the light source as one of a ceiling arrangement and a front arrangement based on a ratio of one of the plurality of second light amounts to the first light amount.

5. The display apparatus as claimed in claim 1, wherein the processor is further configured to:

control the display to display a message inducing a darkroom environment, control the display, in response to the darkroom environment being detected, to display the image with a predetermined brightness, and perform an initial correction with respect to the first sensor and the second sensor based on detected values of the first sensor and the second sensor in the darkroom environment and while the display apparatus is operating with the predetermined brightness.

6. The display apparatus as claimed in claim 1, wherein the processor is further configured to correct the first light amount based on an installation environment of the display apparatus and the position of the light source.

7. The display apparatus as claimed in claim 1, wherein the processor is further configured to determine a reflection ratio in a third direction toward a floor on which the display apparatus is disposed, by using the plurality of second light amounts, and correct the first light amount in further consideration of the reflection ratio.

8. The display apparatus as claimed in claim 1, wherein the processor is further configured to adjust brightness of the display based on the corrected first light amount.

9. The display apparatus as claimed in claim 1, wherein the first sensor is at least one of an illuminance sensor and a color sensor, and the second sensor is at least one of a color sensor, a charge-coupled device (CCD) sensor, and a complementary metal-oxide semiconductor (CMOS) sensor.

10. The display apparatus as claimed in claim 1, wherein the first sensor is disposed on a backside of the display and the display apparatus further comprises a reflection member which reflects light incident from a front surface of the display apparatus and directs the light toward the first sensor.

11. The display apparatus as claimed in claim 10, wherein the second sensor is disposed adjacent to the first sensor on the backside of the display and detects third light which is incident from a third direction of a floor on which the display apparatus is disposed.

12. A method for displaying comprising:

detecting a first light amount of first light which is incident in a first direction from a front side of the display apparatus;

detecting a plurality of second light amounts of different wavelength bands of second light which is incident in a second direction different from the first direction;

determining a position of a light source using any one of the plurality of second light amounts and the first light source;

correcting the first light amount based on the position of the light source; and displaying an image based on the corrected first light amount.

13. The method as claimed in claim 12, further comprising:

determining a type of the light source based on the plurality of second light amounts, wherein the correcting comprises correcting the first light amount based on the position and the type of the light source.

14. The method as claimed in claim 13, wherein the displaying comprises adjusting a color temperature of the image being displayed, based on the type of the light source.

15. The method as claimed in claim 12, wherein the determining comprises determining the position of the light source as one of a ceiling arrangement and a front arrangement based on a ratio of one of the plurality of second light amounts to the first light amount.

16. The method as claimed in claim 12, further comprising:

displaying a message inducing a darkroom environment;

in response to the darkroom environment being detected, displaying the image with a predetermined brightness; and performing an initial correction with respect to the first sensor and the second sensor based on detected values of the first sensor and the second sensor in the darkroom environment and while the display apparatus is operating with the predetermined brightness.

17. The method as claimed in claim 12, wherein the correcting comprises correcting the first light amount based on an installation environment of the display apparatus and the position of the light source.

18. The display apparatus as claimed in claim 12, further comprising:

determining a reflection ratio in a third direction toward a floor on which the display apparatus is disclosed, by using the plurality of second light amounts, wherein the correcting comprises correcting the first light amount in further consideration of the reflection ratio.

19. The method as claimed in claim 12, wherein the displaying the image comprises adjusting brightness of the display based on the corrected first light amount.

20. A non-transitory computer-readable recordable medium storing instructions which, when executed by a processor, cause the processor to perform operations comprising:

detecting a first light amount of first light which is incident in a first direction from a front side of the display apparatus;

detecting a plurality of second light amounts of different wavelength bands of second light which is incident in a second direction different from the first direction;

determining a position of a light source using any one of the plurality of second light amounts and the first light source;

correcting the first light amount based on the position of the light source; and displaying an image based on the corrected first light amount.

* * * * *